US007854030B2

(12) United States Patent
Lee et al.

(10) Patent No.: US 7,854,030 B2
(45) Date of Patent: Dec. 21, 2010

(54) UTILITY TUB WITH REMOVABLE RACK

(75) Inventors: Chia Ying Lee, Chicago, IL (US); Victor Hoernig, Lowell, IN (US)

(73) Assignee: American Shower and Bath, Moorestown, NJ (US)

( * ) Notice: Subject to any disclaimer, the term of this patent is extended or adjusted under 35 U.S.C. 154(b) by 440 days.

(21) Appl. No.: 11/876,791

(22) Filed: Oct. 23, 2007

(65) Prior Publication Data

US 2009/0100591 A1 Apr. 23, 2009

(51) Int. Cl.
*A47J 47/20* (2006.01)

(52) U.S. Cl. ..... 4/656; 4/619; 4/628; 4/637; 4/632; 4/548; 211/41.3; 211/41.9

(58) Field of Classification Search ..... 4/656, 4/619, 628, 637, 632, 548, 654, 641, 431, 4/638; 211/41.3, 41.9
See application file for complete search history.

(56) References Cited

U.S. PATENT DOCUMENTS

D324,902 S * 3/1992 Kohler et al. ..... D23/271
5,715,547 A * 2/1998 Becker et al. ..... 4/619
5,881,404 A * 3/1999 Knight ..... 4/645
D442,037 S * 5/2001 Wong ..... D7/698

* cited by examiner

*Primary Examiner*—Gregory L Huson
*Assistant Examiner*—Lauren Heitzer
(74) *Attorney, Agent, or Firm*—Carlson, Gaskey & Olds PC

(57) ABSTRACT

A utility tub is provided with a sink area having support surfaces for removably supporting a tray. The tray may hold items that are drying. In addition, the utility tub may be provided with an enlarged area for supporting other items, and various accessories such as a towel rack or towel pegs.

2 Claims, 3 Drawing Sheets

UTILITY TUB WITH REMOVABLE RACK

BACKGROUND OF THE INVENTION

This application relates to a utility tub of the type having a free standing sink on legs, wherein a removable rack is positioned within the sink to support items.

Utility tubs are known. A typical utility tub includes a large open sink area supported on stand alone legs. Since these tubs have typically been utilized for any number of purposes, they have not been provided with accessories that would facilitate and expand their use for purposes such as draining or drying items.

SUMMARY OF THE INVENTION

In a disclosed embodiment of this invention, a utility tub has a sink with a support area for supporting a removable tray. In disclosed embodiments, the tray can have drain features such that it can be utilized to drain or dry items. Since the tray is removable, the entire open sink area is also available.

In other features, the utility tub may be provided with an enlarged area to one side of the sink for supporting various items. In addition, a towel rack can be integrally connected on the utility tub.

These and other features of the present invention can be best understood from the following specification and drawings, the following of which is a brief description.

DETAILED DESCRIPTION OF THE PREFERRED EMBODIMENT

Figure 1:
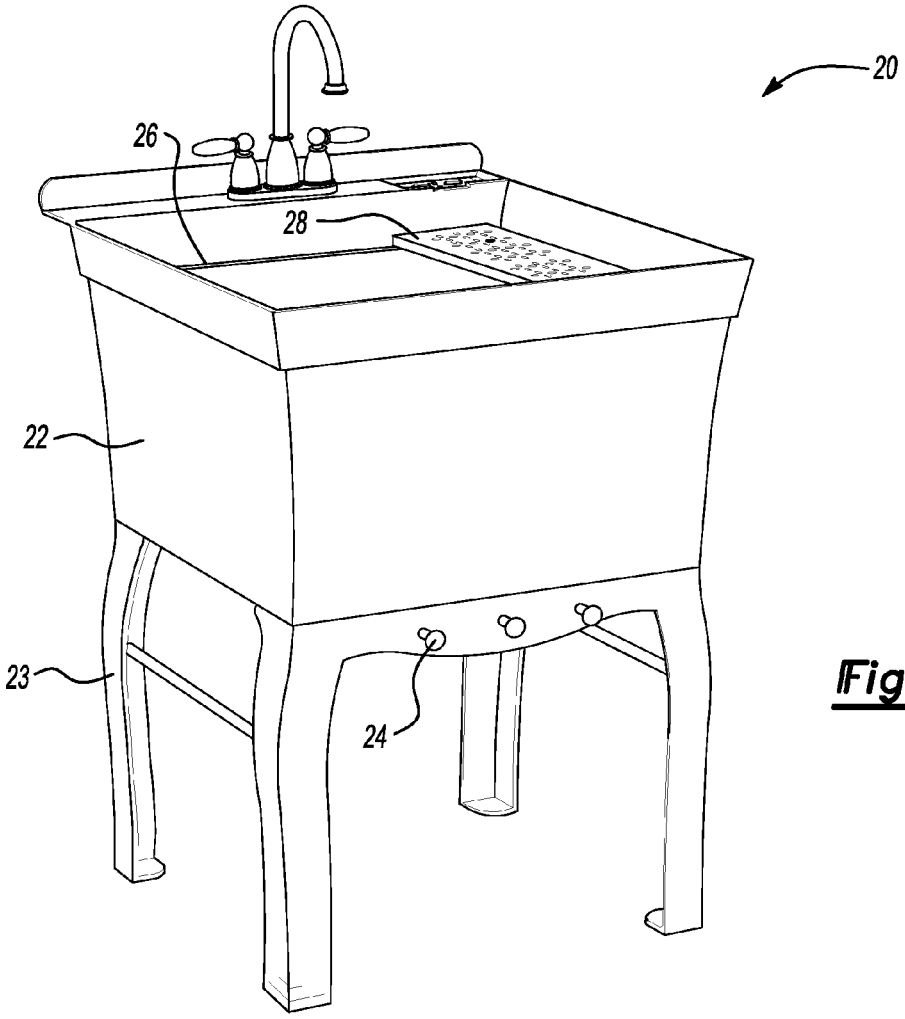
FIG. 1 is a schematic view of a utility tub incorporating the present invention.

A utility tub 20 is illustrated in FIG. 1 having a sink area 22 supported on stand alone legs 23. As shown, towel pegs 24 may be associated with the legs. As known, a faucet allows water to flow into the utility tub. A drain, not shown, is also provided.

In the utility tub 20, a ridge 26 extends around at least the forward and rear walls of the sink area 22. This ridge supports a tray 28.

Figure 2:
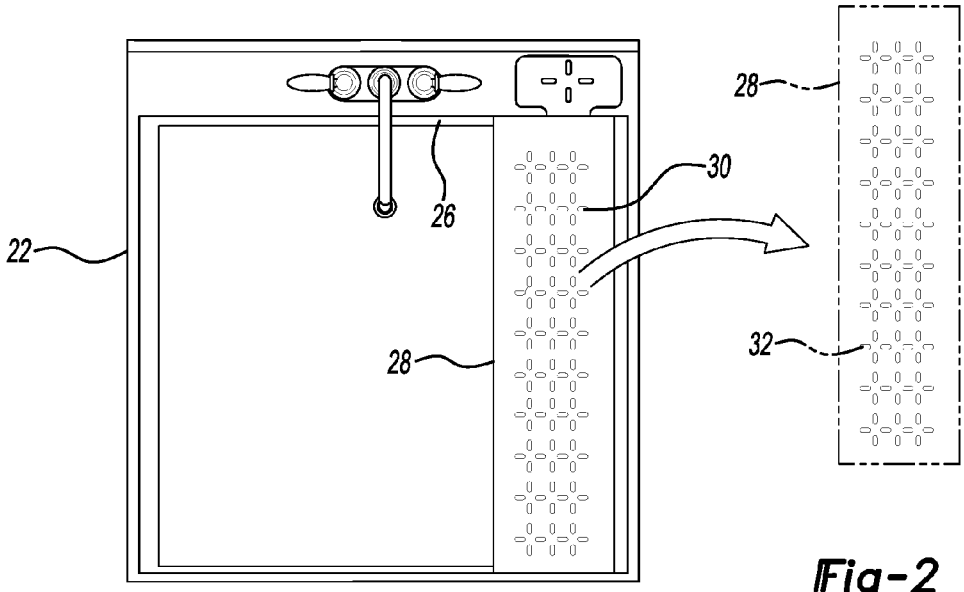
FIG. 2 is a top view of the FIG. 1 tub.

As shown in FIG. 2, the tray 28 includes drain holes 32. Thus, the tray can be utilized to support items that have been washed in the sink 22 and are now drying. The items may include sponges, scrub brushes, paint brushes, flower pots, etc. As is clear from FIG. 2, the ridge 26 extends around all four sides.

As shown at 32, the tray 28 is removable.

Figure 3A:
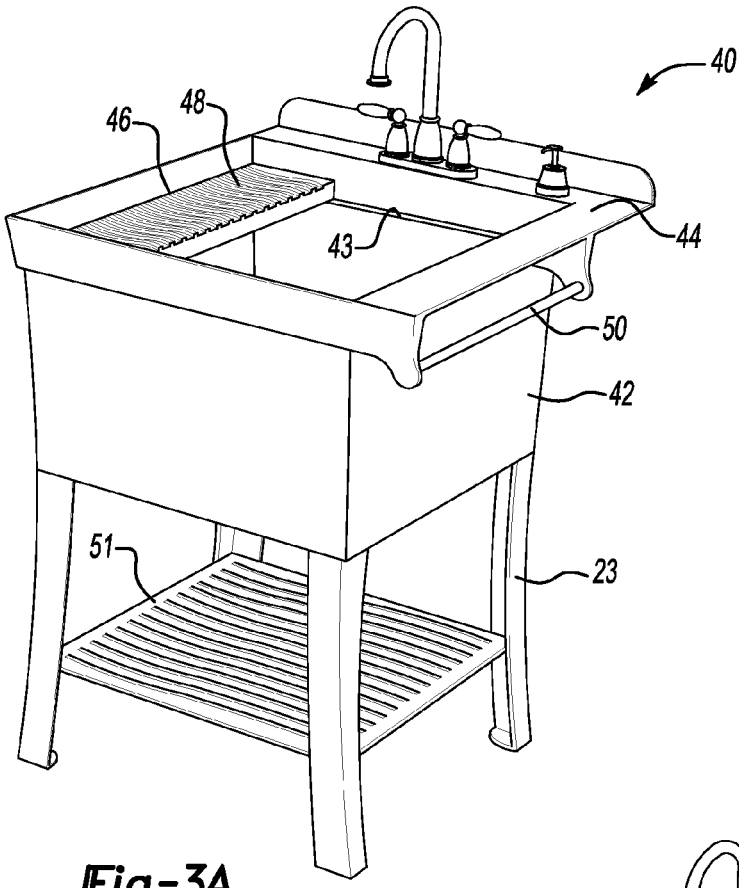
FIG. 3A shows a second embodiment in a first orientation.

FIG. 3A shows another embodiment 40 wherein the sink 42 is provided with a ledge 43 as in the first embodiment. An enlarged support area 44 is formed to one side of the sink 42. In addition, a lower support surface 51 may be associated with the legs 23.

The tray 46 is formed with drain grooves 48, again to drain away water from drying items.

Figure 3B:
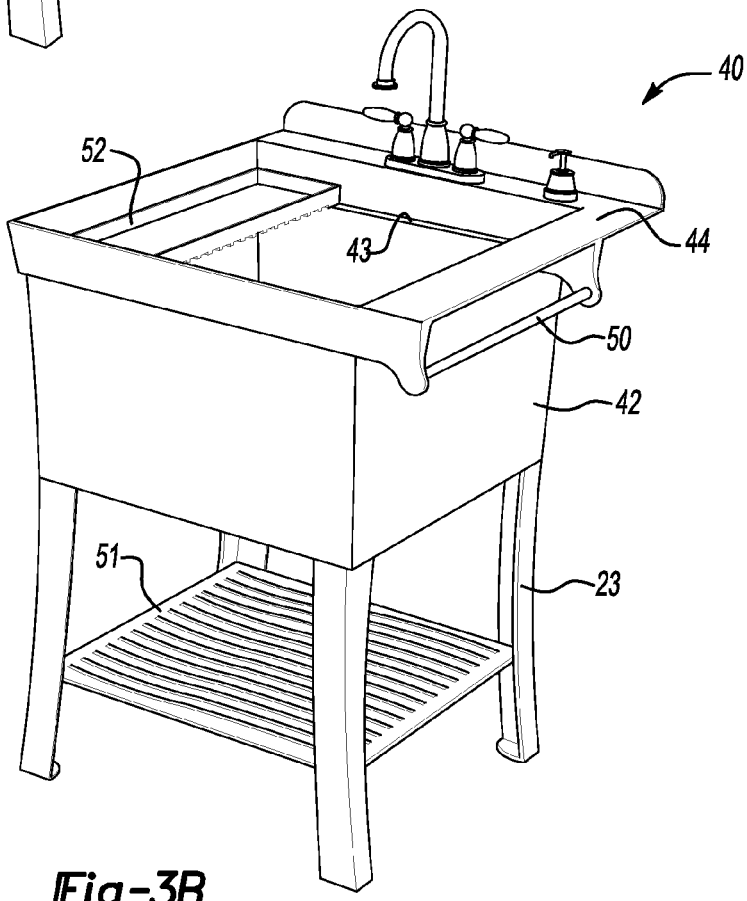
FIG. 3B shows a second embodiment in an alternative orientation.

As shown in FIG. 3B, the tray 46 can be reversed to an orientation at which it provides an enclosed holding space. This orientation allows the tray to be used to presoak items prior to washing, or simply hold items.

Figure 4:
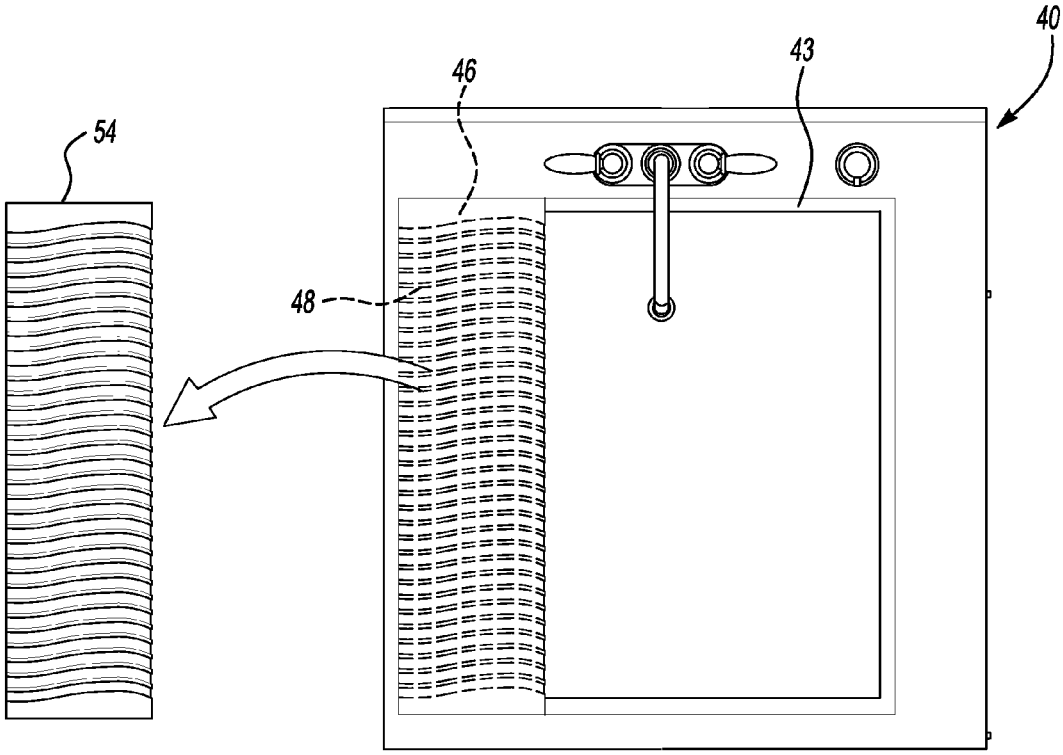
FIG. 4 if a top view of the second embodiment.

As shown at 54 in FIG. 4, the tray 46 can be removed.

Figure 5:
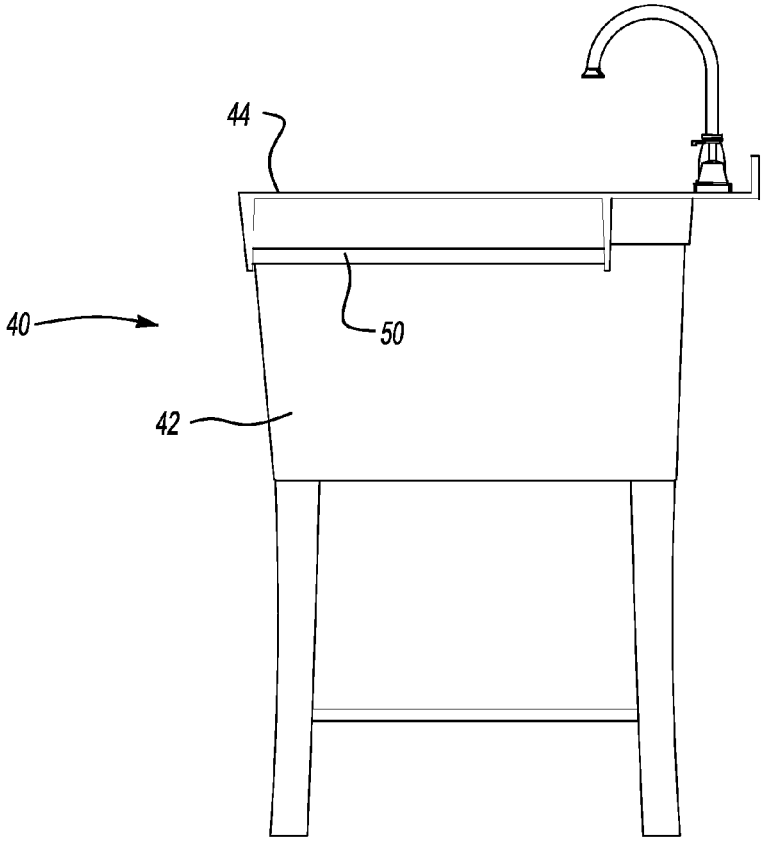
FIG. 5 is a side view of the second embodiment.

As shown in FIG. 5, the enlarged area 44 is provided with a towel rack 50.

In embodiments of this invention, the sink, the ledge, the area 44 and the towel rack 50 may all be molded as a one-piece plastic item. The legs 23 may then be attached to the sink. Of course, other ways of forming the utility tubs of this invention may be utilized.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A utility tub comprising:

a sink for receiving water from a faucet, and having;

an open top, two side portions, a back portion holding said faucet and a front portion;

support structure on said sink, said support structure removably supporting a tray that extends from said front portion of the sink to said back portion of the sink, said support structure formed of a ridge within said sink on said one front portion and a ridge within said sink on said back portion; and said tray is reversible, and having at least two distinct constructions on opposed sides including a first construction that facilities draining articles on a first side and a second construction on a second side that forms an enclosed space; and legs for supporting said sink.

2. The utility tub as set forth in claim 1, wherein said first construction includes grooves extending continuously from one side edge to another side edge for receiving and holding items to dry, and said second construction includes said enclosed space for soaking articles therein.

* * * * *